US005988646A

United States Patent [19]

Fair

[11] Patent Number: 5,988,646

[45] Date of Patent: Nov. 23, 1999

[54] IMPACT SENSOR AND TARGET APPARATUS EMBODYING THE SAME

[75] Inventor: Thomas C. Fair, Guelph, Canada

[73] Assignee: Fairshot, Inc., Guelph, Canada

[21] Appl. No.: 08/767,869

[22] Filed: Dec. 17, 1996

[30] Foreign Application Priority Data

Dec. 21, 1995 [CA] Canada ..... 2165923

[51] Int. Cl.[6] ..... F41J 5/052; F41J 5/056

[52] U.S. Cl. ..... 273/371; 273/374; 310/339

[58] Field of Search ..... 273/371, 374, 273/377, 378, 348, 108.1, 317.2, 127 A, 127 B, 127 R; 473/446, 470, 471, 478, FOR 132; 310/314, 352, 353, 354, 339, 364

[56] References Cited

U.S. PATENT DOCUMENTS

| | | | |
|---|---|---|---|
| 1,716,275 | 6/1929 | Junker | 273/377 |
| 3,455,553 | 7/1969 | Melvin | 273/348.2 |
| 4,029,315 | 6/1977 | Bon | 473/439 |
| 4,078,187 | 3/1978 | Kanisawa et al. | 310/339 |
| 4,581,506 | 4/1986 | Bai et al. | 310/339 |
| 4,607,842 | 8/1986 | Daoust | 473/446 |
| 4,770,527 | 9/1988 | Park | 356/28 |
| 5,029,873 | 7/1991 | Davis | 273/376 |
| 5,046,729 | 9/1991 | Yancey | 273/26 A |
| 5,238,243 | 8/1993 | Grispi | 273/389 |
| 5,509,650 | 4/1996 | MacDonald | 273/127 A |

FOREIGN PATENT DOCUMENTS

| | | | |
|---|---|---|---|
| 1175458 | 10/1984 | Canada | 473/FOR 132 |
| 1206496 | 6/1986 | Canada | 473/FOR 132 |
| 961719 | 9/1982 | Russian Federation . | |

*Primary Examiner*—Jessica J. Harrison
*Assistant Examiner*—John M Hotaling, II
*Attorney, Agent, or Firm*—Jones, Tullar & CooperPC

[57] ABSTRACT

The invention provides a sensor for detecting impacts from, for example, a hockey puck striking a target apparatus embodying the sensor. The sensor uses a thin brass disc to which is secured a piezoelectric ceramic disc. In one embodiment an insulating disc having an electrically conductive element passing therethrough is held against the ceramic disc. In another embodiment a plastic spring clip carries an electrically conductive element at one end in contact with the ceramic disc. A wire is soldered to the brass disc and another wire is soldered to the electrically conductive element. The sensor may be incorporated into a spring biased sensor assembly which is positioned adjacent a medium that is expected to receive impact blows. The sensor will detect such blows and provide, consistently, a signal to indicate reception of the blows. The sensor can withstand a vast multitude of impacts without failure as the wires are not physically loaded.

18 Claims, 4 Drawing Sheets

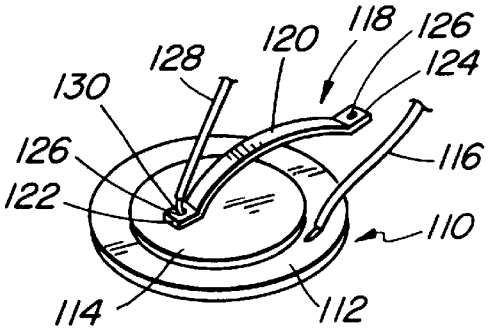
FIG. 3A
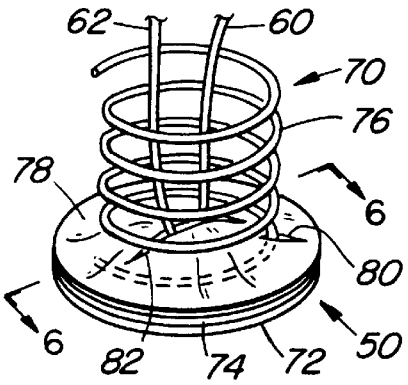
FIG. 5
FIG. 6
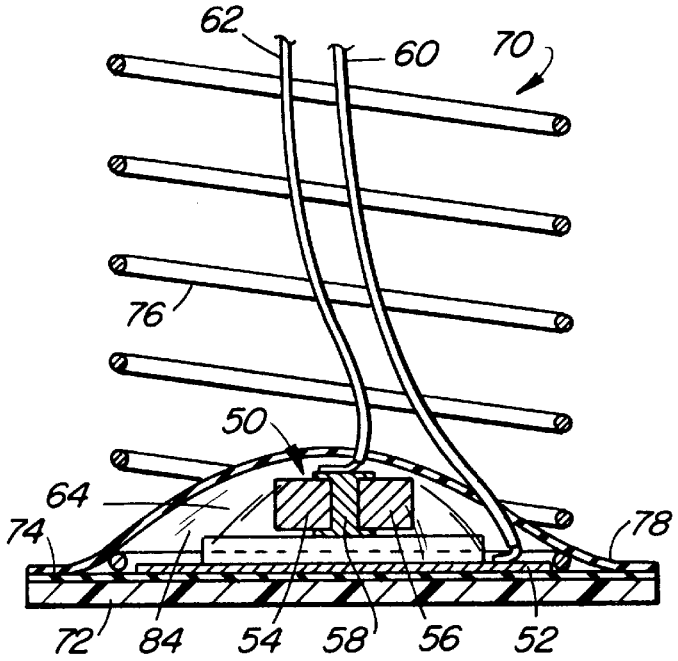
FIG. 6A
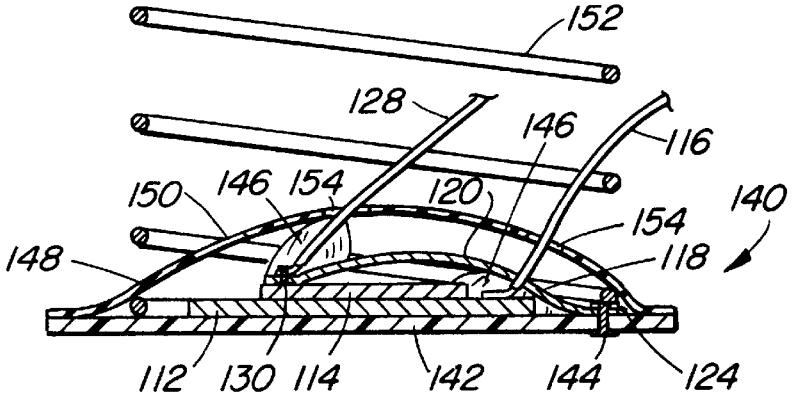

IMPACT SENSOR AND TARGET APPARATUS EMBODYING THE SAME

The present invention relates to a piezoelectric impact sensor and to a target apparatus embodying the sensor.

BACKGROUND OF THE INVENTION

There are several target devices available to sportsmen which are intended to provide sporting enjoyment and/or which can be used to improve the skill level of the participant. A dart board or a target for pistol or rifle shooting come to mind. The targets used in these devices are penetrated by a projectile and thus provide an indication of the position thereon that has been struck by the projectile. Eventually, targets of this type are destroyed by the projectiles.

There are other games which employ game pieces that are projected towards a target, and which are played on a larger scale than, for example, the game of darts. The team sports of hockey, baseball, and lacrosse are examples of games using small projectiles which are propelled at high speed towards a target zone, whether the zone be a goal as in hockey and lacrosse, or a strike zone as in baseball. The projectile must be shot or thrown (pitched) with a high degree of accuracy in order to reward the player with a goal or a strike as the case may be. Usually the player has to practice long and hard in order to hone his skills to the point where he can be confident that his shot or pitch will result in a goal or a strike. Furthermore, since the goal in hockey or lacrosse is protected by an opposing player (the "goalie"), and since the strike zone in baseball is also protected by a opposing player (the "batter"), the shooter or the pitcher must take the opposing player into account with his shot or his pitch. He must send his projectile towards the spot in the target zone where he anticipates that the opponent will not be positioned, so that he has a fair chance of succeeding with a goal or a strike.

There are numerous devices available which can be used by a hockey player, for example, to enable him to practice the accuracy of his shot. Such devices can be found for example in U.S. Pat. No. 4,607,842 or in Soviet Patent No. 961,719. The former requires a lane structure with a frame at one end simulating a net. A target at each corner has a light associated therewith which when illuminated indicates the target to be shot at. The target is pivotally connected to the frame and has a switch that when struck by the target will turn the light out to signal a hit on the target. The latter patent has a frame with a plurality of nets therein, each of which is associated with a signal light that is lit up when a projectile is caught in the net. Both of these devices are intended for "dry land" training of an athlete and do not adequately simulate a game situation where the player may be moving as he is shooting.

There is a need for a more sophisticated target apparatus that can be used by a player to simulate game situations and which can be used anywhere, including on the "playing field", just as the real goal or target would be used. Also, there is a need for apparatus that will withstand the rigors of high impact shots in the order of 100 miles per hour, as can be attained by major league hockey and baseball players. The present invention addresses both of these needs.

SUMMARY OF THE INVENTION

The present invention provides a target apparatus that can be used on the "playing field" by players of all ages and skill levels to help the players improve their abilities in game situations. It can be programmed to randomly define any one of a plurality of individual target zones and it can provide a readout of the number of "hits", the total number of shots taken, or any other information that may be valuable or of interest to the player. The invention also provides an impact sensor at the heart of the target apparatus, which sensor can withstand the repeated high impacts suffered by the apparatus without failure. The apparatus of this invention will be of great use to individuals and teams as they endeavour to improve their skill levels. The apparatus can also be used for entertainment at fairs, or at halls of fame devoted to a particular sport, where participants can test their abilities against a computer, against their friends or against skill levels established by well-known players from the professional ranks.

Although the target apparatus of this invention and the impact sensor which is utilized therewith were developed with the game of hockey in mind, and are described in that context herein, it is clear that the principles of the invention could be applied to any sport or game in which accuracy of "shooting" or "throwing" is required.

In one embodiment the present invention may be considered as providing a sensor for detecting impact on a medium comprising: a thin metallic substrate mountable to the medium; a piezoelectric ceramic disc adhered to one major surface of the substrate; an insulating disc adjacent the ceramic disc and having an electrically conductive element passing therethrough to contact the ceramic disc; a first electrically conductive wire secured to the substrate in spaced relation to the ceramic disc; a second electrically conductive wire secured to the electrically conductive element; and sealing means surrounding the ceramic disc and the insulating disc to hermetically seal the discs with respect to the substrate, the first and second wires extending from the sealing means; whereby when the medium suffers an impact the ceramic disc generates an electric signal which may be communicated via the wires to suitable detecting and signalling means.

In another embodiment the present invention provides a sensor for detecting impact on a medium comprising: a thin metallic substrate mountable to the medium; a piezoelectric ceramic disc adhered to one major surface of the substrate; a first electrically conductive wire secured to the substrate in spaced relation to the ceramic disc; an electrically insulating spring clip having spaced apart ends with an electrically conductive element at one end thereof in contact with the ceramic disc; and a second electrically conductive wire secured to the electrically conductive element; whereby when the medium suffers an impact the ceramic disc generates an electric signal which may be communicated via the wires to suitable detecting and signalling means.

The present invention may also be considered to provide a sensor assembly for detecting impact on a medium comprising: a thin plastic disc for contacting the medium; a sensor as defined above positionable in contact with the plastic disc and spring means for biasing the plastic disc against the medium; and flexible means adhered to the plastic disc, containing the sensor, and holding the spring means against the plastic disc; the spring means extending from the flexible means for contact with means for compressing the spring means to apply a biasing force to the plastic disc against the medium; whereby when the medium suffers an impact the ceramic disc generates an electric signal which may be communicated via the wires to suitable detecting and signalling means.

Finally, the invention may be considered as providing a target apparatus comprising: a frame; a plurality of target areas defined within the frame, each target area presenting a target face; a housing for each target area, with the target face at the front of the housing; illumination means for each target area, the illumination means being selectively visible to an observer; a sensor assembly as defined above mounted in each housing with the target face thereof being the medium; and electric power means in series with the wires of the sensor and the illumination means of the housing; whereby an impact on any target face will activate the illumination means thereof to signal an impact on that target face to the observer.

In the case of a target apparatus for the game of hockey the frame would be of the same size as a hockey goal and there would preferably be at least nine rectangular target areas of the same size filling the front of the goal. One of those areas would also contain a readout for the information generated after each shot at the goal. The target areas could be randomly or sequentially identified as a target to be shot at by a player and the target apparatus could be used on "dry land" or on a rink so that a player could take his shots from anywhere relative to the goal and while he is moving, as in a real game.

BRIEF DESCRIPTION OF THE DRAWINGS

FIG. 3A is a perspective view of a second embodiment of a piezoelectric sensor as used in this invention.

FIG. 5 is an enlarged perspective view of a sensor assembly using a first embodiment sensor.

FIG. 6 is a vertical section of the sensor assembly on the line 6—6 of FIG. 5.

FIG. 6A is a vertical section of a sensor assembly using the second embodiment sensor.

DESCRIPTION OF THE PREFERRED EMBODIMENT

Figure 7:
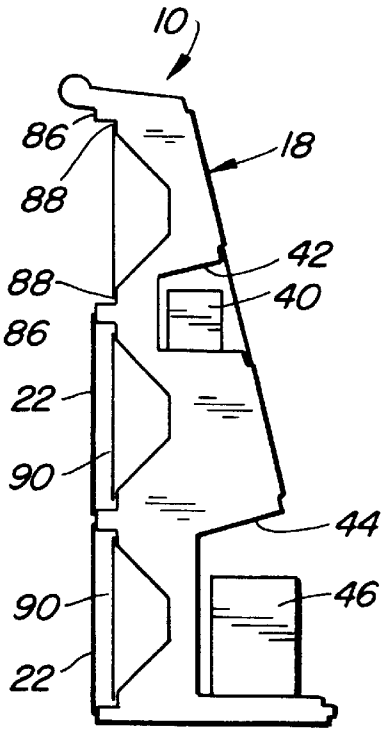
FIG. 7 is a vertical section through the target apparatus of the present invention, taken on the line 7—7 of FIG. 1.
Figure 1:
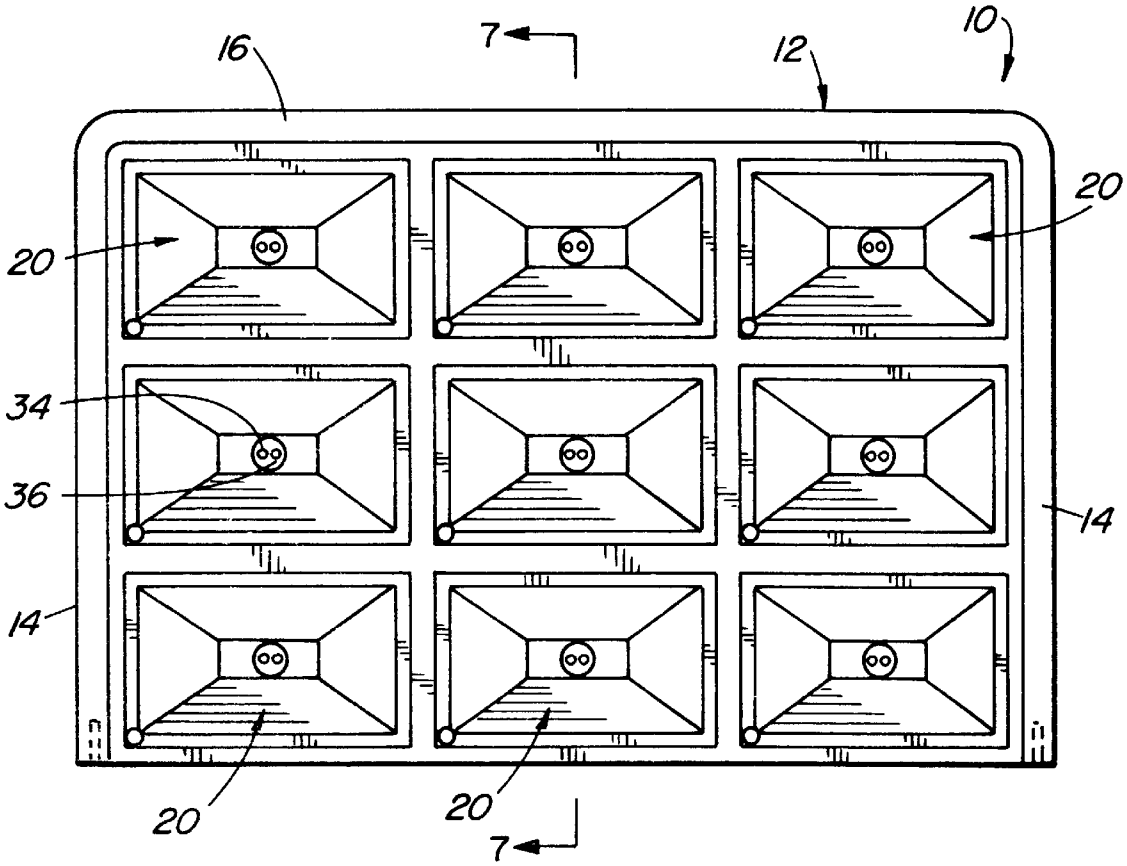
FIG. 1 is a front elevation of a target apparatus according to this invention.

FIG. 1 shows a front view of a target apparatus 10 in accordance with this invention, the apparatus taking on the form of a goal or net as used in the game of hockey. The invention will be described in relation to this apparatus and the game of hockey although as mentioned above the principles of the invention could be applied to almost any game or sport in which a projectile is hit, shot or thrown towards a target. Target apparatus in accordance with this invention could be developed for, without restriction, lacrosse, baseball, football, golf, darts, soccer, rugby, curling, polo, cricket, et cetera, as well as for hockey.

The target apparatus 10 includes a free-standing frame 12 having a rectangular front defined by vertical and horizontal frame members 14, 16, respectively. A rear housing 18, to be described hereinafter, provides support for the frame 12 and maintains the frame 12 in a vertical orientation. The vertical frame members could be open at the bottom for attachment to goal-securing means as used at hockey rinks to anchor a regulation goal during play. The dimensions of the frame 12 should be the same as those of a regulation goal, namely a rectangular opening having a width of six feet and a height of four feet. The front of the frame 12 is divided into nine target areas 20, each of which has identical dimensions, nominally 24 inches by 16 inches. The actual frontal area of each target area will be somewhat less than the maximum available from the nominal dimensions, due to additional framework to be described below.

Figure 2:
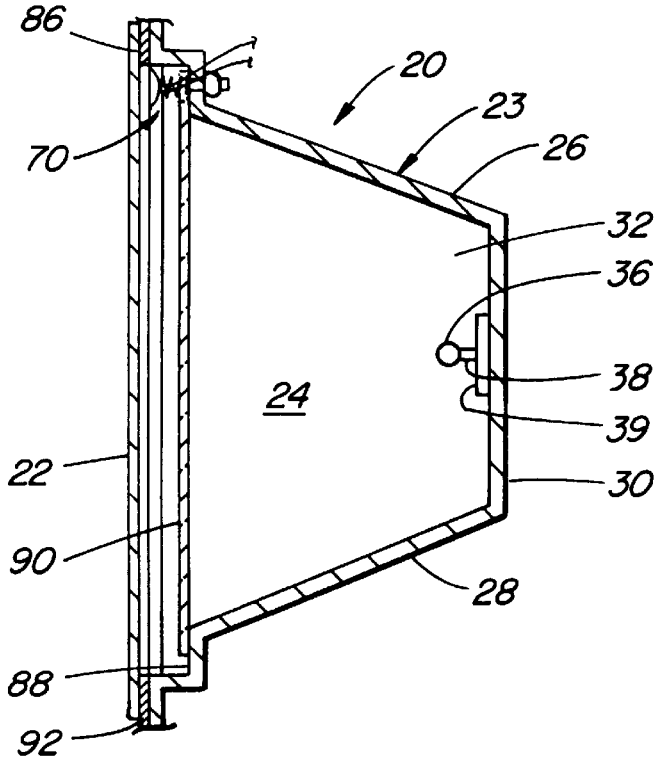
FIG. 2 is a cross-sectional view of the interior of a target area of the apparatus of FIG. 1.

FIG. 2 illustrates the interior of a target area 20 with the target area including a housing 23 defined by rearwardly and inwardly sloping trapezoidal end panels 24, top panel 26 and bottom panel 28, all of which terminate at a vertical back panel 30. The inner surfaces of the panels 24, 26, 28 and 30 are covered with a suitable reflective material 32, such as aluminum foil or a matte silver polyester material having an adhesive layer on the back side thereof. A pair of lights, one red (34) and one white (36) are mounted in appropriate sockets 38 within the housing 23 at the back panel 30. The sockets 38 are actually mounted to a resilient pad 39 which will help to absorb the shock of impacts on the apparatus. The lights are electrically connected to a control module 40, carried in a pocket 42 of the rear housing 18. Another pocket 44 in the rear housing is adapted to contain a battery 46 which will provide power to the apparatus of this invention. Although the apparatus is designed to operate on DC power it could be wired directly into a suitable source of AC power if desired and if appropriate modifications well within the purview of an electrician were accomplished.

Figure 3:
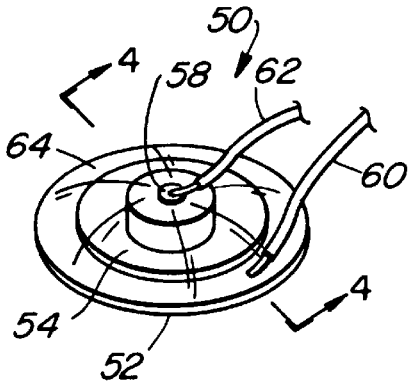
FIG. 3 is a perspective view of a first embodiment of a piezoelectric sensor as used in this invention.

The heart of the target apparatus of this invention is the impact sensor 50 seen in FIGS. 3 to 6 or the sensor 110 seen in FIGS. 3A and 6A. These sensors have been developed to withstand the repeated impacts imposed on the target apparatus by hockey pucks travelling at speeds in the vicinity of 100 miles per hour without failing. Commercially available piezoelectric impact sensors are completely unable to withstand impacts of the order sustained by the present invention without being destroyed in short order. Failure is usually associated with destruction of the electrical circuit due to one of the wires thereof becoming disconnected from the sensor under repeated impacts.

Figure 4:
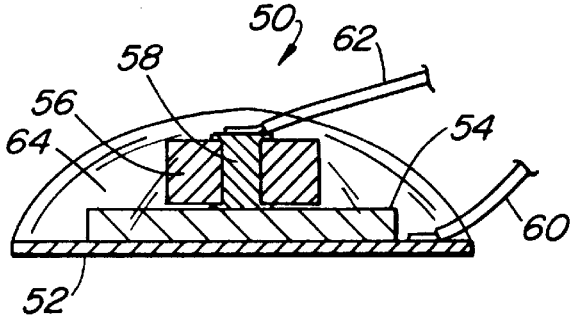
FIG. 4 is an enlarged vertical section of the sensor on the line 4—4 of FIG. 3.
Figure 8:
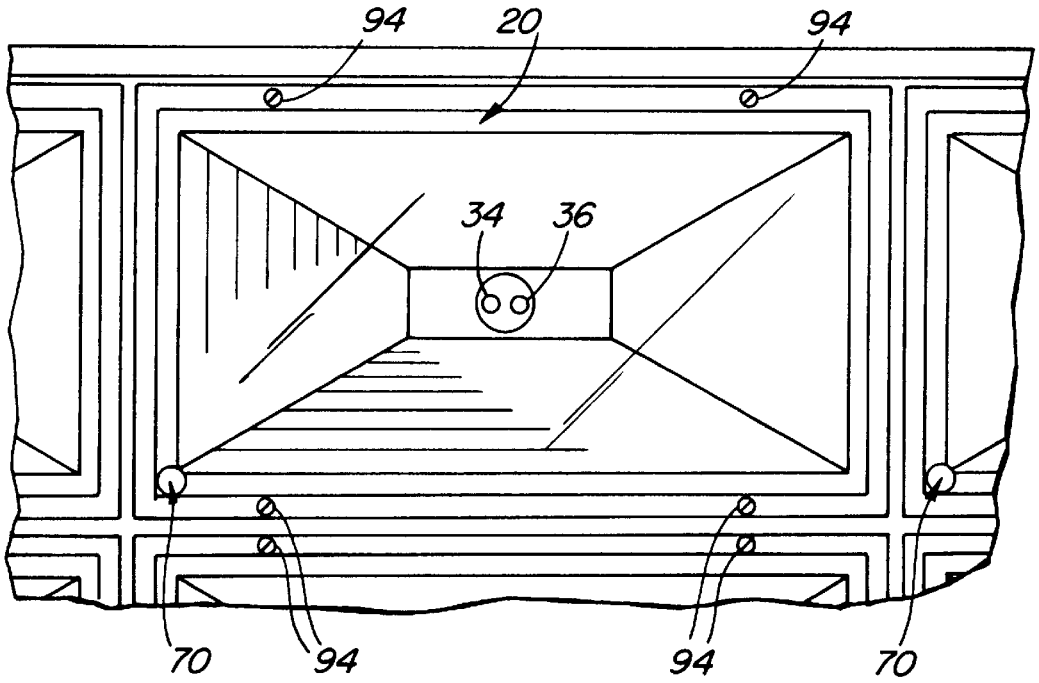
FIG. 8 is an enlarged view of a target zone showing the positioning of the sensor assembly.
Figure 9:
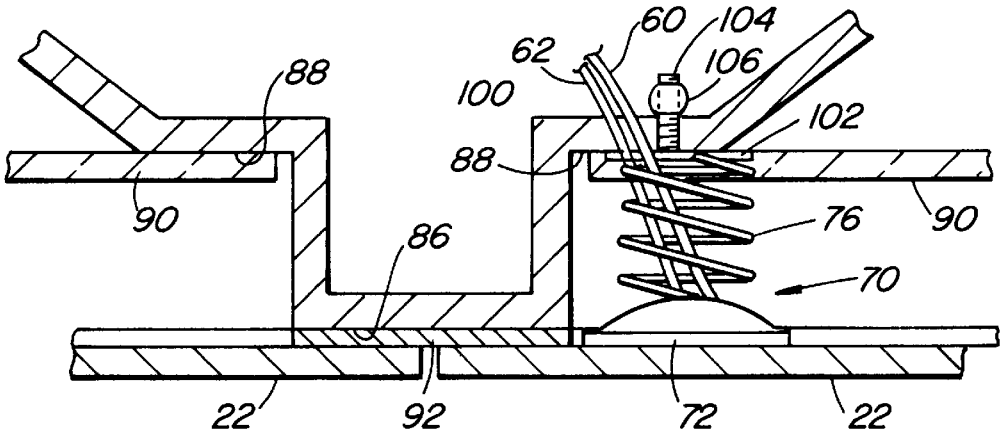
FIG. 9 is an enlarged section at the juncture of the frame and one of the target areas.

With reference to the drawings it will be seen that in a first embodiment the sensor 50 includes a thin metallic disc 52 of a material such as brass, to which is adhered a commercially available thin piezoelectric ceramic disc 54. A thicker electrically insulative disc 56 has an electrically conductive metallic element 58 extending therethrough such that one end of the element will contact the ceramic disc when the disc 56 is placed thereon. The element 58 may be, for example, a rivet inserted through a central hole in the disc 56 and upset on both sides thereof to provide a raised metallic contact on each side of the disc 56. A first electrically conductive wire 60 is soldered to the disc 52 in a conventional manner and a second electrically conductive wire 62 is soldered to the opposite (exposed) end of the metallic element 58. An embedding material 64 such as silicone covers the exposed portions of the discs 52, 54 and 56, and the wires 60 and 62 project therefrom as seen in FIGS. 3 and 4.

The sensor 50 is incorporated into a sensor assembly 70 shown more particularly in FIGS. 5 and 6. The assembly includes a thin plastic disc 72 made from, preferably, a polycarbonate such as Lexan® to which is adhered a thin layer 74 of flexible material such as rubber. A compression spring 76 is provided and the spring is held in contact with the rubber layer 74 by another rubber layer or disc 78 which has a slit 80 therein. The slit 80 is passed over one of the coils of the spring 76 close to one end thereof and is peripherally adhered to the disc forming the layer 74. A slit 82 cut into the rubber layer 78 allows a sensor 50 as previously described to be pushed into a cavity 84 between the layer 74 and the disc 78, with the wires 60 and 62 projecting from the slit 82. The metallic disc 52 of the sensor 50 will be in contact with the layer 74 and thus in contact with the plastic disc 72.

The wires 60 and 62 pass through the slit 82 so that they may be connected to the electrical circuitry of the target apparatus of the invention. The sensor assembly including the disc 72, the rubber layers 74 and 78, the sensor 50 and the compression spring 76 may now be positioned adjacent a front face of a target area in order to create an electrical impulse via the piezoelectric ceramic disc whenever the face receives an impact from a projectile such as a hockey puck.

The sensor 50 and the sensor assembly 70 were developed for the target apparatus described herein but it is clear that the sensor and the sensor assembly can be used in any situation calling for an electrical signal in response to a impact load on the sensor. The sensor and the sensor assembly described herein will withstand repeated high impact loads without failing, due in part to the fact that the second wire 62 is isolated from the ceramic disc 54, that the connection for each of the wires 60 and 62 to the disc 52 and the element 58 is not under tension because of the embedding material 64, and that the sensor 50 is held in a floating manner against the face to receive the impacts by the spring 76 acting on the disc 72.

Turning now to FIGS. 3A and 6A another sensor and sensor assembly will be described. In this embodiment the sensor 110 includes a thin metallic disc 112 of a material such as brass, to which is adhered a commercially available thin piezoelectric ceramic disc 114. A first electrically conductive wire 116 is soldered to the metallic disc 112 in a conventional manner. A plastic clip 118 is formed with a central hump portion 120 and flattened ends 122 and 124, each of which has a hole 126 therethrough. A second electrically conductive wire 128 is riveted to one end 122 of the clip, with the rivet 130 forming a contact surface on the underside thereof for contact with the piezoelectric disc 114.

The sensor 110 is incorporated into a sensor assembly 140 shown more particularly in FIG. 6A. The assembly includes a thin plastic disc 142 made from, preferably, a polycarbonate such as Lexan®. The metallic disc 112 is adhered to the plastic disc 142 and the other end 124 of the clip 118 is riveted to the disc 142 as by the rivet 144. A dollop of silicone potting compound 146 is placed above the rivet 130 and between the clip 118 and the solder joint for wire 116 to relieve stresses in the assembly and to, in the case of the one end 122 of the clip, to help hold the rivet 130 against the ceramic piezoelectric disc 114. A flexible cover in the form of rubber layer or disc 148 is adhered around its periphery to the upper surface of the plastic disc 142, adjacent its periphery. The disc 148 has a slit 150 therein which receives a compression spring 152 therethrough as in the sensor assembly 70. The disc 148 also has slits 154 therethrough, through which the conductive wires 116 and 118 pass for connection to appropriate electrical circuitry of the target apparatus of this invention.

Figure 10:
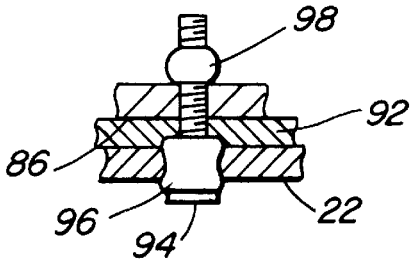
FIG. 10 is a partial section showing the attachment of the target panel to the frame.

With reference to FIGS. 2, and 7 to 10 the rest of the target apparatus of this invention will now be described. The front of the frame includes a flat face 86 and a stepped shoulder 88 extending peripherally about the opening to the housing 24. The shoulder 88 receives a transparent acrylic panel 90. A strip of foam material 92, such as PSA VOLARA™, is placed against the face 86, which material will cushion the impact from a hockey puck so as to reduce somewhat the harsh noise generated by the impacts. The face panel 22 for the target area 20 is placed against the foam material 92 and is floatingly attached to the frame by way of bolts 94 passing through rubber bushings 96, suitable holes in the panel 22 and the foam material 92 and then into rubberised well-nuts 98 held behind the part of the frame defining the face 86 (FIG. 10). The sensor assembly 70 or 110 is positioned against the inside surface of the panel 22 between the panel 22 and the shoulder 88 as in FIGS. 8 and 9. The shoulder 88 thus acts as a backing plate operating on the free end of the spring 76 or 152 so as to apply a compression force on the spring and thereby hold the disc 72 or 142 in position against the panel 22. The wires 60, 62 or 118, 128 are passed through an opening 100 in the shoulder 88 for connection to the control module. A washer 102, bolt 104, and rubberised well-nut 106 can be used to hold the sensor assembly 50 in position.

The control module 40 contains appropriate solid state circuitry to effect the desired programming options for the target apparatus of this invention. The circuitry and the programming thereof is well within the capabilities of a skilled technician and does not form a part of this invention. The control module could be programmed to selectively activate all of the lights and to extinguish those that have been struck by a projectile, in response to a signal from the sensor assembly associated with the struck target area. Alternatively one could start with all lights extinguished, with the control module randomly lighting a target area, the light thereof being extinguished when that area is struck. Many other options could be programmed into the module.

One of the target areas, such as the middle one, could contain an LED readout module which could indicate the number of shots received by the target apparatus, the time elapsed since start-up, the number of hits against identified target areas and any other data useful to a user of the apparatus. The readout module would be contained within a target housing 23 and would be positioned behind the panel 90 so that it would be protected by both panels 22 and 90.

The panel 90, as indicated above, is transparent. The panel 22 could also be transparent, or it could be translucent so as to diffuse the light emanating from the lights 34,36. Furthermore the panels 22 and/or 90 could carry appropriate advertising or other messages if desired.

The present invention encompasses several elements which can be used singly, such as the sensor itself, or in combination with other elements to provide a sensor assembly or a target apparatus embodying the features of the sensor and the sensor assembly. It is clear that skilled practitioners could modify the basic invention or the combinations in which the invention is utilized without departing from the spirit of the invention. Accordingly the protection to be afforded this invention is to be determined from the claims appended hereto.

I claim:

1. A sensor for detecting impact on a medium comprising: a thin metallic substrate mountable to said medium; a piezoelectric ceramic disc adhered to one major surface of said substrate; an insulating disc adjacent said ceramic disc and having an electrically conductive element passing therethrough to contact said ceramic disc; a first electrically conductive wire secured to said substrate in spaced relation to said ceramic disc; a second electrically conductive wire secured to said electrically conductive element; and sealing means surrounding said ceramic disc and said insulating disc to hermetically seal said discs with respect to said substrate, said first and second wires extending from said sealing means; whereby when said medium suffers an impact said ceramic disc generates an electric signal which may be communicated via said wires to suitable detecting and signalling means.

2. The sensor of claim 1 wherein said metallic substrate is a brass disc, said electrically conductive element is a metallic rivet passing through said insulating disc and said wires are secured to said brass disc and to said rivet by soldering.

3. A sensor assembly for detecting impact on a medium comprising: a thin plastic disc for contacting said medium; a sensor according to claim 1 positionable in contact with said plastic disc; spring means for biasing said plastic disc against said medium; and flexible means adhered to said plastic disc, containing said sensor, and holding said spring means against said plastic disc; said spring means extending from said flexible means for contact with means for compressing said spring means to apply a biasing force to said plastic disc against said medium; whereby when said medium suffers an impact said ceramic disc generates an electric signal which may be communicated via said wires to suitable detecting and signalling means.

4. The assembly of claim 3 wherein said metallic substrate is a brass disc, said electrically conductive element is a metallic rivet passing through said insulating disc and said wires are secured to said brass disc and to said rivet by soldering.

5. The assembly of claim 4 wherein said flexible means comprises a first rubber disc adhered to said plastic disc, and a second rubber disc engaging said spring means and peripherally adhered to said first rubber disc to hold said one end of the spring means against said first rubber disc, said second rubber disc including an opening therethrough to permit insertion of said sensor into a cavity defined between said rubber discs with said wires extending from said cavity through said opening.

6. A target apparatus comprising: a frame; a plurality of target areas defined within said frame, each target area presenting a target face; a housing for each target area, with the target face at the front of the housing; illumination means for each target area, said illumination means being selectively visible to an observer; a sensor assembly according to claim 3 mounted in each housing with the target face thereof being said medium; and electric power means in series with the wires of the sensor and the illumination means of the housing; whereby an impact on any target face will activate the illumination means thereof to signal an impact on that target face to the observer.

7. The target apparatus of claim 6 including means for randomly activating any of said illuminating means, a detected impact against an activated target area causing the illuminating means thereof to extinguish.

8. The target apparatus of claim 6 wherein said frame includes a stepped shoulder peripherally adjacent the front of each housing, said target face is secured to said frame, and said sensor assembly is positioned between said target face and said shoulder.

9. The target apparatus of claim 8 including a layer of cushioning foam material between said target face and said frame.

10. A sensor for detecting impact on a medium comprising: a thin metallic substrate mountable to said medium; a piezoelectric ceramic disc adhered to one major surface of said substrate; a first electrically conductive wire secured to said substrate in spaced relation to said ceramic disc; an electrically insulating spring clip having spaced apart ends with an electrically conductive element at one end thereof in contact with said ceramic disc; and a second electrically conductive wire secured to said electrically conductive element; whereby when said medium suffers an impact said ceramic disc generates an electric signal which may be communicated via said wires to suitable detecting and signalling means.

11. The sensor of claim 10 wherein said metallic substrate is a brass disc, said electrically conductive element is a metallic rivet passing through said one end of said spring clip and said wires are secured to said brass disc and to said rivet by soldering.

12. A sensor assembly for detecting impact on a medium comprising: a thin plastic disc for contacting said medium; a sensor according to claim 10 positionable in contact with said plastic disc; spring means for biasing said plastic disc against said medium; sealing means covering the connections between said first and second wires and said substrate and said element respectively; rivet means connecting the other end of said spring clip to said plastic disc; and flexible cover means adhered to said plastic disc, defining a cavity containing said sensor, and holding said spring means against said plastic disc; said spring means extending from said flexible cover means for contact with means for compressing said spring means to apply a biasing force to said sensor against said medium; whereby when said medium suffers an impact said ceramic disc generates an electric signal which may be communicated via said wires to suitable detecting and signalling means.

13. The assembly of claim 12 wherein said metallic substrate is a brass disc, said electrically conductive element is a metallic rivet passing through said one end of said clip and said wires are secured to said brass disc and to said rivet by soldering.

14. The assembly of claim 13 wherein s aid flexible cover means comprises a rubber disc engaging said spring and peripherally adhered to said plastic disc to hold said one end of the spring against said plastic disc, said rubber disc including an opening therethrough to permit said wires to extend from said cavity.

15. A target apparatus comprising: a frame; a plurality of target areas defined within said frame, each target area presenting a target face; a housing for each target area, with the target face at the front of the housing; illumination means for each target area, said illumination means being selectively visible to an observer; a sensor assembly according to claim 12 mounted in each housing with the target face thereof being said medium; and electric power means in series with the wires of the sensor and the illumination means of the housing; whereby an impact on any target face will activate the illumination means thereof to signal an impact on that target face to the observer.

16. The target assembly of claim 15 including means for randomly activating any of said illuminating means, a detected impact against an activated target area causing the illuminating means thereof to extinguish.

17. The target assembly of claim 16 wherein said frame includes a stepped shoulder peripherally adjacent the front of each housing, said target face is secured to said frame, and said sensor assembly is positioned between said target face and said shoulder.

18. The target assembly of claim 17 including a layer of cushioning foam material between said target face and said frame.

* * * * *